US006936957B2

(12) United States Patent
Jeong et al.

(10) Patent No.: US 6,936,957 B2
(45) Date of Patent: Aug. 30, 2005

(54) ANTI-HOWLING DEVICE IN CATHODE RAY TUBE

(75) Inventors: Pyeong Su Jeong, Kyongsangbuk-do (KR); Jong Eon Choi, Kyongsangbuk-do (KR); Jin Chul Park, Kyongsangbuk-do (KR)

(73) Assignee: LG Electronics, Inc., Seoul (KR)

( * ) Notice: Subject to any disclaimer, the term of this patent is extended or adjusted under 35 U.S.C. 154(b) by 23 days.

(21) Appl. No.: 09/978,549

(22) Filed: Oct. 18, 2001

(65) Prior Publication Data

US 2003/0011293 A1 Jan. 16, 2003

(30) Foreign Application Priority Data

Jul. 12, 2001 (KR) ..... 2001-41952
Jul. 12, 2001 (KR) ..... 2001-41954
Jul. 12, 2001 (KR) ..... 2001-41955

(51) Int. Cl.[7] ..... H01J 29/81; H01J 29/07
(52) U.S. Cl. ..... 313/404; 313/50; 313/402
(58) Field of Search ..... 313/402, 404, 313/407

(56) References Cited

U.S. PATENT DOCUMENTS 4,318,025 A 3/1982 Penird et al. ..... 313/404
4,827,179 A * 5/1989 Adler et al. ..... 313/402
5,289,080 A * 2/1994 Park ..... 313/402
6,469,429 B1 * 10/2002 Berton ..... 313/402
6,469,431 B1 * 10/2002 Suzuki et al. ..... 313/407

FOREIGN PATENT DOCUMENTS

EP 0984482 A2 3/1999
EP 1089311 A2 4/2001
JP 01206544 A * 8/1989 ..... H01J/29/07
JP 11-054061 2/1999
JP 11250826 A * 9/1999 ..... H01J/29/07
JP 2001-155654 6/2001
JP 2001185047 A * 7/2001 ..... H01J/29/07

OTHER PUBLICATIONS

R. Adler et al., An Unusual Proble in Vibration Damping: The Flat Tension Mask Computer Tube, Oct. 1989, IEEE 1989 Ultrsonics Symposium Proceedings, vol. 2, PP 1093–1097.*

* cited by examiner

*Primary Examiner*—Ashok Patel
*Assistant Examiner*—Mariceli Santiago
(74) *Attorney, Agent, or Firm*—Fleshner & Kim, LLP

(57) ABSTRACT

Anti-howling device in a cathode ray tube including anti-howling means having contact members each in contact with a shadow mask for receiving, and dispersing a vibration, and connecting members for connecting adjacent contact members, and fixing means for actually bringing the contact members in the anti-howling means into contact with the shadow mask, wherein the contact members receive the vibration of the shadow mask, to disperse the vibration by impact and friction between the contact members and the shadow mask.

32 Claims, 9 Drawing Sheets

ANTI-HOWLING DEVICE IN CATHODE RAY TUBE

BACKGROUND OF THE INVENTION

1. Field of the Invention

The present invention relates to an anti-howling device in a cathode ray tube, and more particularly, to an anti-howling device in a cathode ray tube, which has an excellent howling attenuation effect, and a simple fabrication process.

2. Background of the Related Art

The cathode ray tube is provided with a panel having a fluorescent film coated on an inside surface thereof, and a funnel having conductive graphite coated on an inside surface thereof. There is an electron gun at an end of the funnel, and a deflection yoke at a neck part of the funnel for deflection of electron beams. There is a shadow mask fitted to an inside of the panel for selecting a color to light the fluorescent film. Accordingly, the electron beams from the electron gun are deflected to a required position by the deflection yoke, and land on the fluorescent film via the shadow mask, to reproduce a picture on a screen.

In the meantime, the shadow mask is very thin to cause howling when an external load is applied to the cathode ray tube, to require an anti-howling device for attenuation of vibration transmitted to the shadow mask. FIG. 1 illustrates a perspective view of a related art anti-howling device in a cathode ray tube, referring to which the related art anti-howling device will be explained.

As explained, the shadow mask 5 is fitted to an inside of the panel 1. The shadow mask 5 has an effective area 5*a* having slots 11 for passing the electron beams from the electron gun, and a non-effective area 5*b* which is a part the shadow mask 5 is fitted to the anti-howling wire 7 of approx. 60–80 $\mu$m thick is fitted to the shadow mask 5. The wire 7 is assembled to the shadow mask 5 according to the following steps. At first, wire fastening, members, i.e., brackets 9, are fitted to both ends of the wire 7. Then, the brackets 9 are fitted to a mask holding frame 3 respectively, to complete the assembly. The wire 7 is fitted at a central portion of the shadow mask in a height direction (i.e., 12–6 o'clock direction), when care should be taken so that no wire 7 runs over the slots 11 in the shadow mask 5. The wire 7 is so thin that an electron microscope is in general required for the assembly.

The working principle of the related art anti-howling device in a cathode ray tube will be explained. When the shadow mask 5 vibrates by an external load, the vibration is transmitted to the wire 7. The vibration is attenuated by impact and friction caused between the wire 7 and the shadow mask 5. In this instance, it is preferable that a tension is given to the wire 7 so that the wire has a natural frequency smaller than the shadow mask 5. A howling attenuation characteristic is dependent on a thickness of the wire, a strength of the tension give, a position of the wire strapping, material of the wire, and working condition.

However, the foregoing related art anti-howling device in a cathode ray tube has the following problems.

First, because the related art anti-howling device in a cathode ray tube has approx. 15–60 seconds of a time period required for attenuation of a vibration after the vibration is occurred, a vibration attenuation time period, the vibration attenuation effect is poor. Moreover, since the vibration attenuation time period has a grate deviation between the devices for the same external load, the device reliability is poor.

Second, the complicated assembly process of the wire to the shadow mask is causes of defective products and a high product cost. As explained, a wire pass through process requires steps of providing the wire, fitting the wire to the brackets, positioning the wire at a required position of the shadow mask, and welding the brackets to the mask holding frame. As the wire is very thin, a precise fabrication process is required, and the wire liable to breakage, or to cause defective welding during the fabrication process, to cause much fabrication time period delay, and to require manual work always due to difficulty of automation, that pushes a production cost up.

Third, even if the assembly is successful, the wire fastening may be loosened as the wire or the shadow mask is deformed during a heating process of the cathode ray tube, to fail to work properly, or the wire is seen on the screen.

SUMMARY OF THE INVENTION

Accordingly, the present invention is directed to an anti-howling device in a cathode ray tube that substantially obviates one or more of the problems due to limitations and disadvantages of the related art.

An object of the present invention is to provide an anti-howling device in a cathode ray tube, which can improve a vibration attenuation effect.

Other object of the present invention is to provide an anti-howling device in a cathode ray tube, which can simplify an assembly process for minimizing a production cost.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the anti-howling device in a cathode ray tube includes anti-howling means having contact members each in contact with a shadow mask for receiving, and dispersing a vibration, and connecting members for connecting adjacent contact members, and fixing means for actually bringing the contact members in the anti-howling means into contact with the shadow mask, wherein the contact members receive the vibration of the shadow mask, to disperse the vibration by impact and friction between the contact members and the shadow mask.

The contact member is spherical, or cylindrical, with a pass through hole for passing an end of the connecting member.

The contact member includes a contact part having a pass through hole at one side, and a connecting part formed as a unit with the contact part, wherein the connecting member has a form actually identical to the contact member.

The contact member has a ring form, and the connecting member also has a ring form.

The anti-howling means is preferably fitted to a non-effective area of the shadow mask.

The fixing means is fitted to opposite ends of the connecting member, fitted to a non-effective area of the shadow mask, or to a mask holding frame.

In other aspect of the present invention, there is provided an anti-howling device in a cathode ray tube having fixing means including holding parts for holding opposite ends of the anti-howling means, and fitting parts each extended from the holding part for fitting to the shadow mask, wherein the contact members are brought into contact with the shadow mask by using an elastic tension of the holding parts.

A length between the holding parts is formed shorter than an effective length of the anti-howling means for applying tension to the anti-howling means when the anti-howling means is held by the holding parts.

The holding part includes an indent fit to a profile of the contact member in the anti-howling means.

The fitting part includes a contact hole in conformity with a lower part of the contact member in the anti-howling means, for bringing the contact member into contact with the shadow mask through the contact hole.

The fitting part preferably includes a recess projected in a direction of the shadow mask.

Preferably, the fixing means further includes a connecting part for connecting the holding parts, and, more preferably, the connecting part has a length shorter than an effective length of the anti-howling means for applying tension to the anti-howling means when the anti-howling means is held by the holding parts.

The connecting part preferably includes assembly holes each having a size almost the same with the contact member and slots each connected to the assembly hole having a size almost the same with a diameter of the connecting member in the anti-howling means, and the holding part includes a slot connected to the slot in the connecting part.

The connecting part preferably includes a cutout at approx. center of an edge of the connecting part.

In another aspect of the present invention, there is provided an anti-howling device in a cathode ray tube having fixing means including a guiding part for bringing the contact members in the anti-howling means into contact with the shadow mask, a holding part for holding the connecting members in the anti-howling means, and a fitting part fitted to the shadow mask having one sides of the holding part and the guiding part connected thereto.

Preferably, the fitting part is fixed to the mask holding frame, or to the non-effective area of the shadow mask.

The fitting part preferably includes a recess projected in a direction of the shadow mask.

Thus, the present invention attenuates vibration effectively, and makes an assembly process simple, to reduce a production cost.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
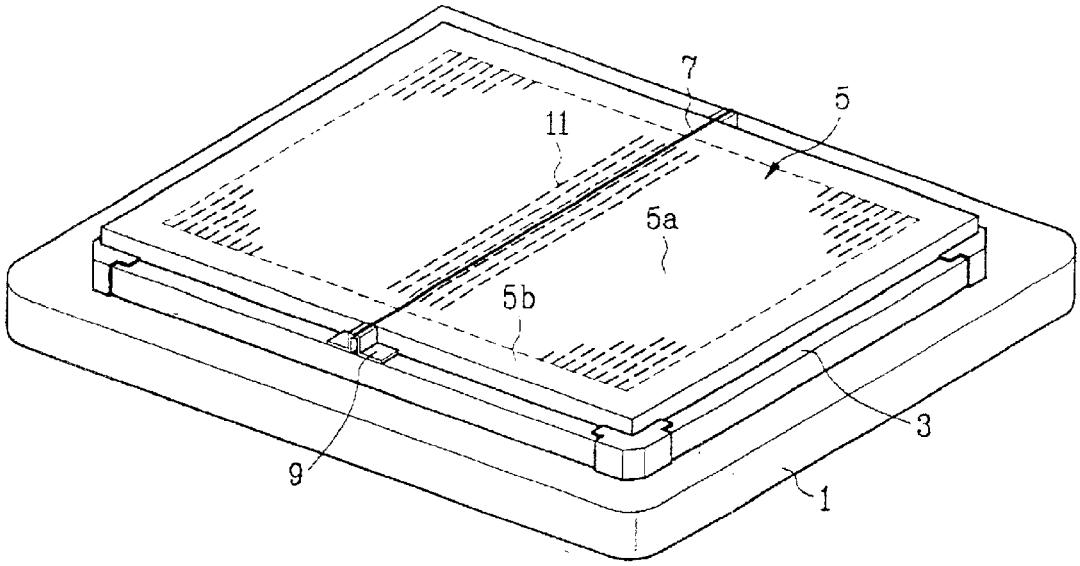
FIG.1 Related Art
FIG. 1 illustrates a perspective view of a related art anti-howling device in a cathode ray tube.
Figure 2:
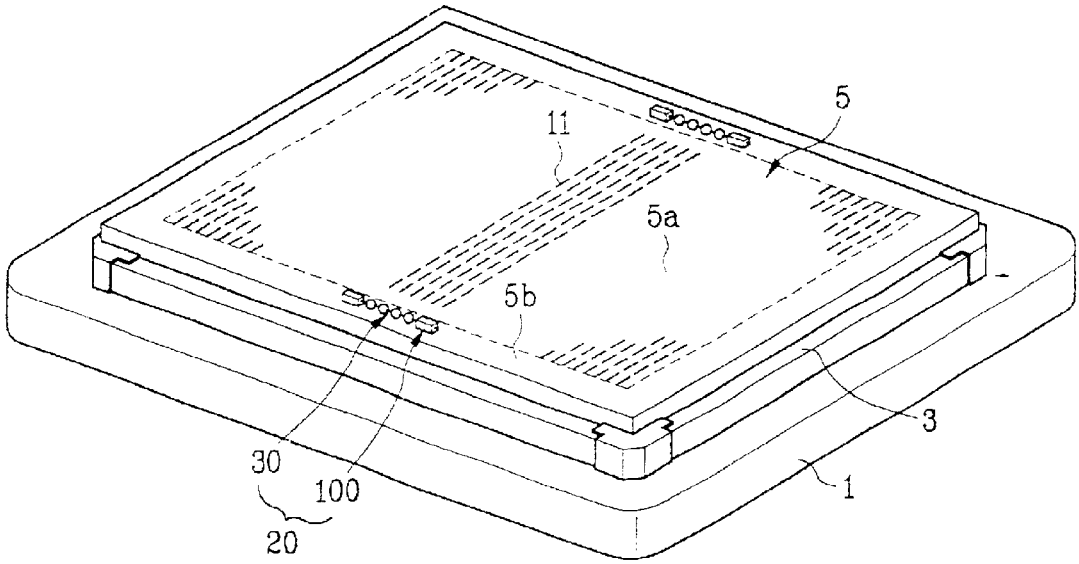
FIG. 2 illustrates a perspective view of an anti-howling device in a cathode ray tube in accordance with a first preferred embodiment of the present invention.

Reference will now be made in detail to the preferred embodiments of the present invention, examples of which are illustrated in the accompanying drawings. FIG. 2 illustrates a perspective view of an anti-howling device in a cathode ray tube in accordance with a first preferred embodiment of the present invention, referring to which an entire system of the anti-howling device in a cathode ray tube of the present invention will be explained.

Referring to FIG. 2, the anti-howling device 20 in accordance with a first preferred embodiment of the present invention includes anti-howling means 30 in contact with a shadow mask 5 for attenuation of vibration, and fixing means 100 for fixing the attenuation means 30 to the shadow mask 5 to be in contact therewith.

The wire in the related art anti-howling device can not but be fitted to run over the effective area 5*a* of the shadow mask in view of the structure. However, the anti-howling device of the present invention can be fitted to a predetermined position on the shadow mask. i.e., either on the effective area 5*a* or the non-effective area 5*b*. However, it is preferable that the anti-howling device is fitted to the non-effective area 5*b* for convenience of fitting, and preventing the anti-howling device shown on the screen after the anti-howling device is fitted.

Figure 3A:
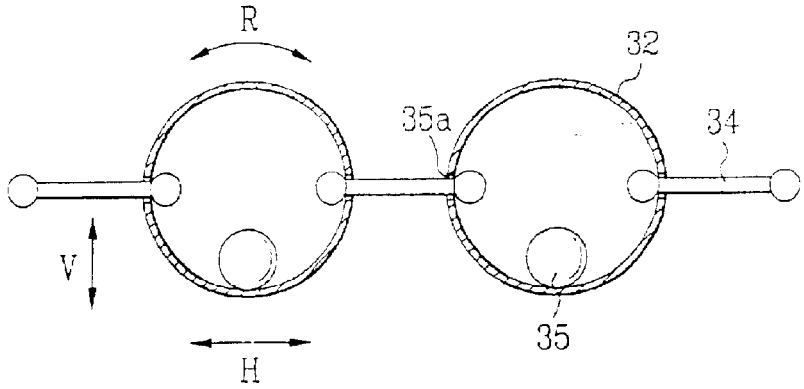
FIGS. 3A–3C illustrate perspective views of variations of anti-howling means of the anti-howling device in a cathode ray tube of the present invention.
Figure 3B:
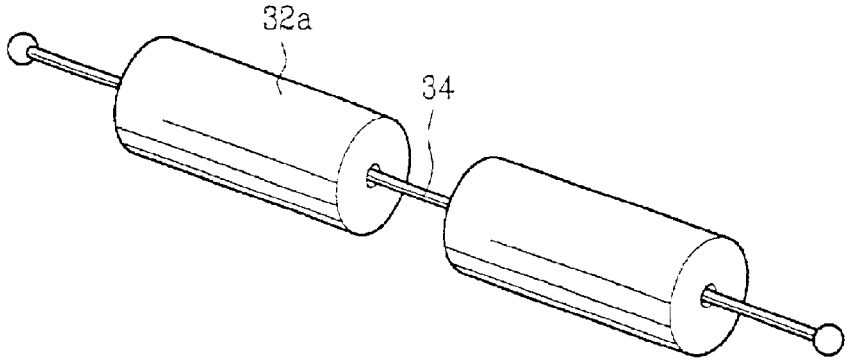
Figure 3C:
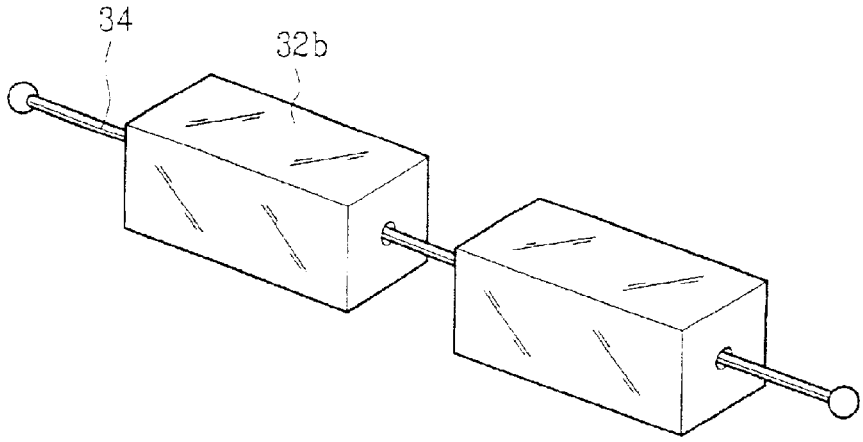

Referring to FIGS. 3A–3C, the anti-howling means in the anti-howling device will be explained.

The anti-howling means 30 includes contact members 32 in contact with the shadow mask for receiving and dispersing vibration, and connecting members 34 for connecting the contact members 32. A part of the contact member 32 is made to be in contact with the shadow mask for receiving a vibration occurred at the shadow mask by an external load at first, and attenuating the vibration by impact, and friction with the shadow mask. There are a plurality of the connecting members 34 for connecting the contact members 32, and it is preferable that those are not connected, directly.

Referring to FIG. 3A, the contact member 32 is spherical, with opposite pass through holes 35*a*. The connecting member 34 is a stick, with both ends inserted in the pass through holes 35*a* in the contact members 32. The contact member 32 may be solid or hollow. When the contact member 32 is hollow, a supplementary contact member 35 may be provided therein.

According to the foregoing system, upon reception of an external vibration, the contact member 32 moves in up and down directions V, to hit the shadow mask, and move in left and right directions H for some extent to make friction with the shadow mask. Eventually, the vibration is attenuated, efficiently. The spherical contact member 32 makes a rotational motion R that can attenuate the vibration. Therefore, the present invention can attenuate the vibration, effectively. The point to point contact of the spherical contact member 32 with the shadow mask is effective to an attenuation of fine vibration occurred in a later part of the vibration because the spherical contact member 32 can maintain contact with the shadow mask even during the fine vibration of the shadow mask.

In the meantime, in order to enhance the friction or impact, the contact member 32 and the connecting member 34 may be heat treated, or embossed. The contact member is not limited only to sphere, but may be cylindrical, or hexahedral. The cylindrical contact member will be explained, with reference to FIG. 3B.

Of course, the anti-howling means in FIG. 3B also includes contact members 32*a* and connecting members 34, except that the cylindrical contact member 32*a* makes a line contact with the shadow mask, to show an excellent attenuation for an initial transient vibration occurred by the external load owing to a contact area greater than the point to point contact.

Next, the hexahedral contact member will be explained with reference to FIG. 3C. The hexahedral contact member 32*b* makes a surface to surface contact with the shadow mask, to have a greater frictional area than the line contact. Therefore, the stronger friction and impact between the hexahedral contact member 32*b* and the shadow mask will provide an excellent vibration attenuation in an in initial transient state. Particularly, the hexahedral contact member 32*b* is suitable to a case when suppression of an initial transient vibration, rather than the fine vibration, of the shadow mask is important because local deformation is small as the shadow mask has great rigidity and modulus of elasticity that permit less deformation.

Figure 4:
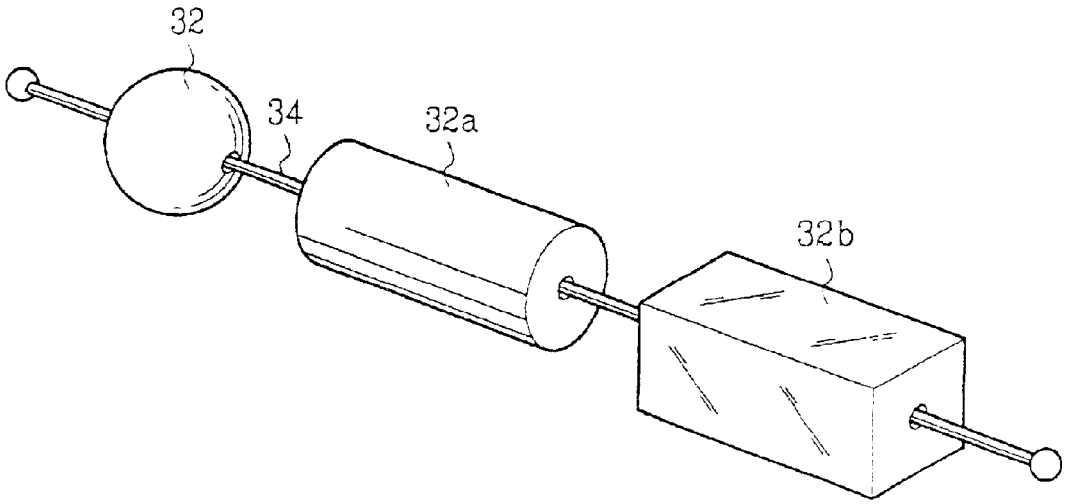
FIG. 4 illustrates perspective view of another variation of anti-howling means of the anti-howling device in a cathode ray tube of the present invention.

Moreover, as shown in FIG. 4, contact members 32, 32*a*, and 32*b* of point contact, line contact, and surface contact may be combined, which permits attenuation of the initial transient vibration by means of the contact members 32*a*, and 32*b* of line contact and surface contact, and the following fine vibration by means of the contact member 32 of the point contact.

Figure 5A:
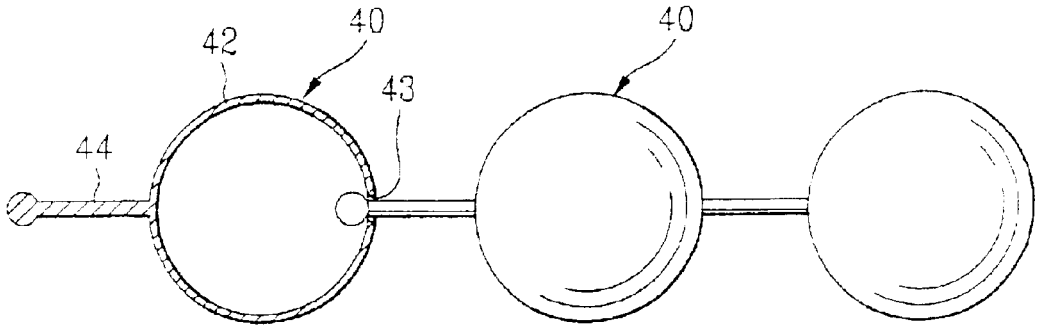
FIGS. 5A–5C illustrate perspective views of another variations of anti-howling means of the anti-howling device in a cathode ray tube of the present invention.

Variations of the anti-howling means of anti-howling device in a CRT of the present invention will be explained, with reference to FIGS. 5A–5C. The variations are similar to the foregoing embodiments on the whole, except that, though the foregoing embodiment has separate contact members and connecting members, the present embodiments have unified contact and connecting members. As shown in FIG. 5A, the contact member 40 of the present embodiment has a contact part 42 for making a contact with a shadow mask, and a connecting part 44 at one side of the contact part 42 for guiding motion of another adjacent contact member 40. That is, there is a connecting part 44 unified at one side of a spherical contact part 42, and a pass through hole 43 in the other side of the spherical contact part 42 for connecting the contact part of other contact member thereto. Therefore, alike the foregoing embodiment, the contact member 40 can make collision and friction with the shadow mask, and rotation with respect to its own axis. Though spherical contact parts are shown in FIG. 5A, the shape of the contact part is not limited thereto, but may be cylindrical for line contact, or hexahedral for surface contact.

Figure 5B:
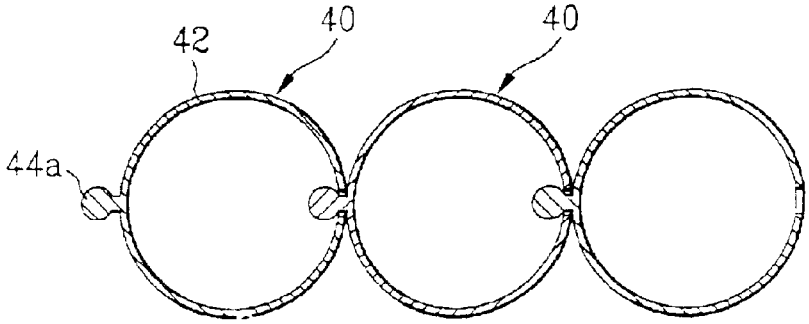

Referring to FIG. 5B, the connecting part 44*a* coupling with the contact part 42 may be shortened.

Figure 5C:
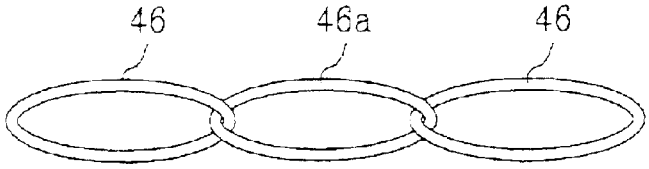

Referring to FIG. 5C, the contact members 46 may be in forms of closed curves, to connect the contact members 46 in a form of a chain, when, it is preferable that the connecting members 46*a* are also chain forms.

In the meantime, the foregoing anti-howling means 30, specifically, the contact member 32 is required to be in contact with a part of the shadow mask, to require the fixing means 100 for fixing the anti-howling means 30 to the shadow mask in contact therewith. The fixing means 100 in FIG. 2 shows one connected to both ends of the anti-howling means 30, and fixed to the shadow mask by means of welding or the like. In this instance, it is preferable that the anti-howling means 30 are connected to the fixing means 100 under tension for making better contact. The fixing means 100 may be fitted to the mask holding frame 3 or the non-effective area 5*b* of the shadow mask.

However, the fixing means is not limited to the foregoing example, but may be anything that can bring the anti-howling means 30 into contact with the shadow mask and fixing the anti-howling means 30 to a required position. It is verified from experiments that the better the contact between the anti-howling means 30 and the shadow mask, the better the vibration suppression performance. Therefore, it is preferable that the fixing means has a structure that can bring the anti-howling means 30 into close contact with the shadow mask, regardless of variation of an external environment. Moreover, both the anti-howling means and the fixing means have fixed patterns, for easy production automation and excellent productivity.

Figure 7:
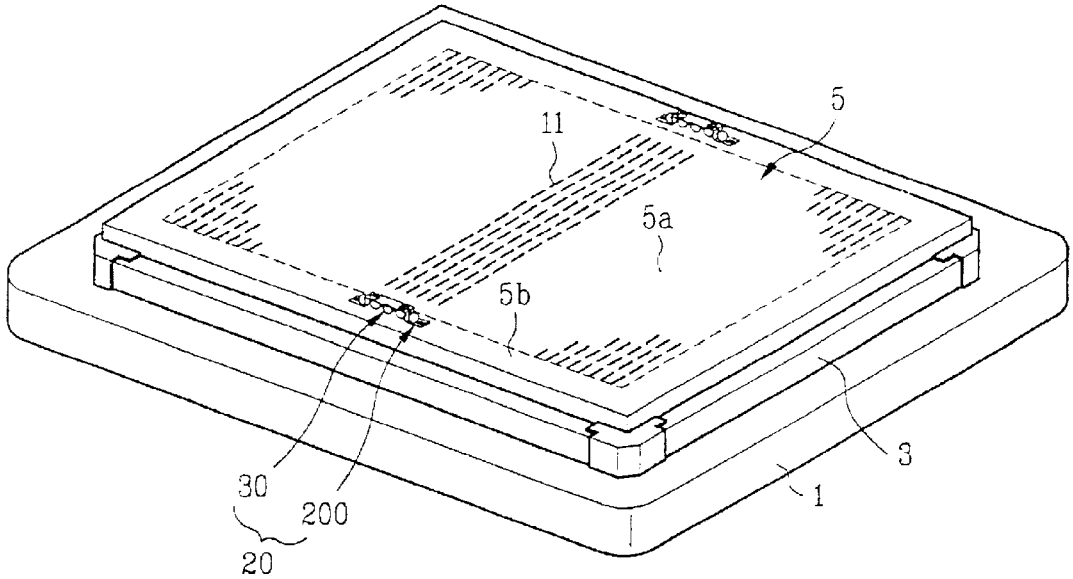
FIG. 7 illustrates a perspective view of an anti-howling device in a cathode ray tube in accordance with a second preferred embodiment of the present invention.

Another embodiment of the fixing means will be explained, with reference to FIGS. 7 to 9.

As described, there is fixing means 200 for holding and fixing anti-howling means 30 to required positions of a shadow mask 5. The fixing means 200 includes holding parts 220 for holding contact members 32 of anti-howling means 30, and fitting parts 230 extended from fore ends of the holding part 220 for fitting the fixing means 200 to the shadow mask 5. There are one pair of the holding parts 220 in one fixing means 200 for holding the contact members 32*a* and 32*b* at opposite ends of the anti-howling means 30. This system facilitates that the contact members 32 are brought into contact with the shadow mask by elastic tension of the holding parts 220.

Figure 8:
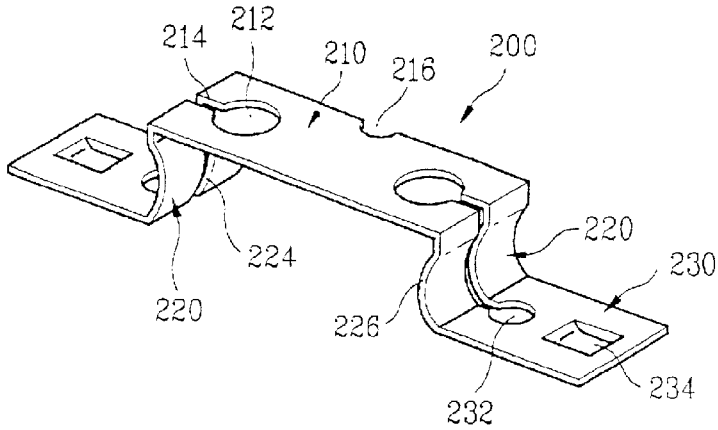
FIG. 8 illustrates a perspective view showing the fastening means in FIG. 7.
Figure 9:
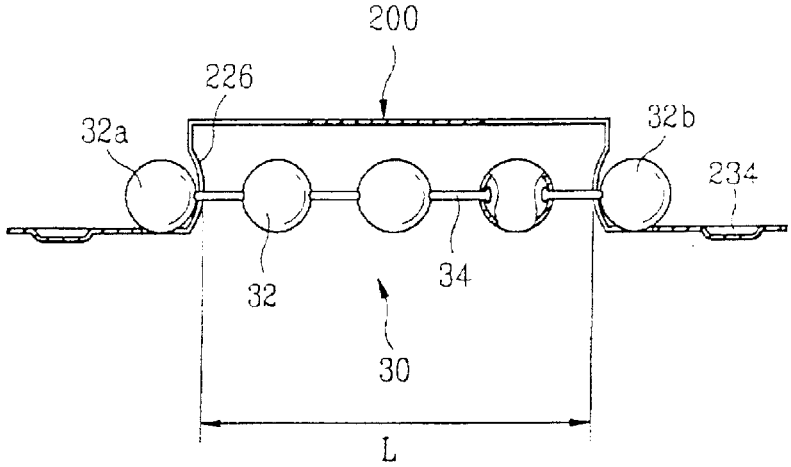
FIG. 9 illustrates a section showing the fastening means in FIG. 7 having the anti-howling means assembled thereto.
Figure 10:
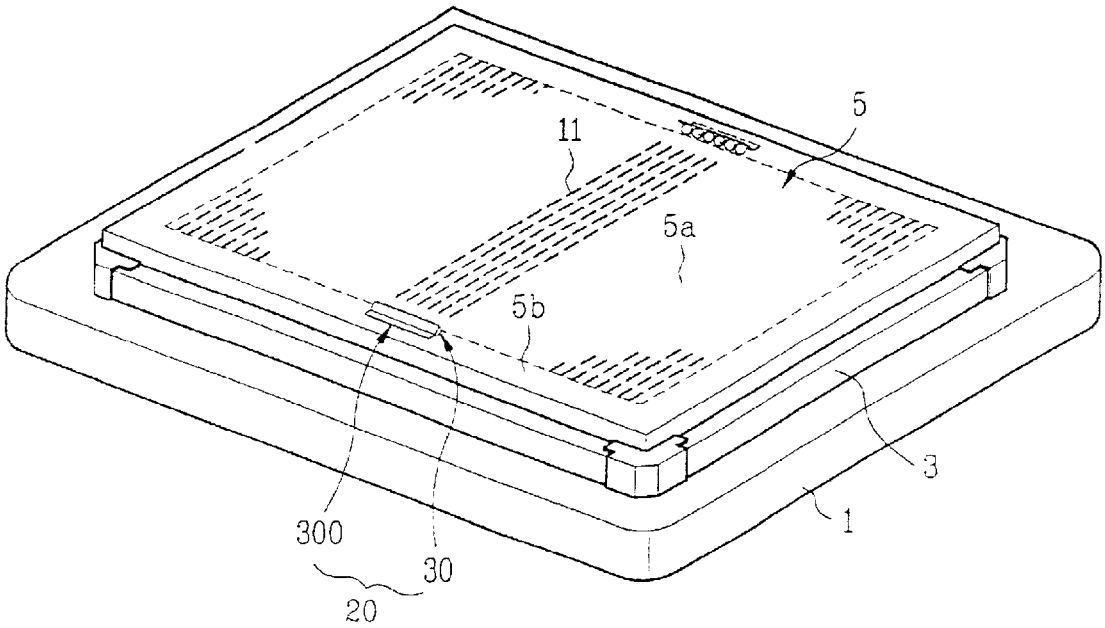
FIG. 10 illustrates a perspective view of an anti-howling device in a cathode ray tube in accordance with a third preferred embodiment of the present invention.
Figure 11:
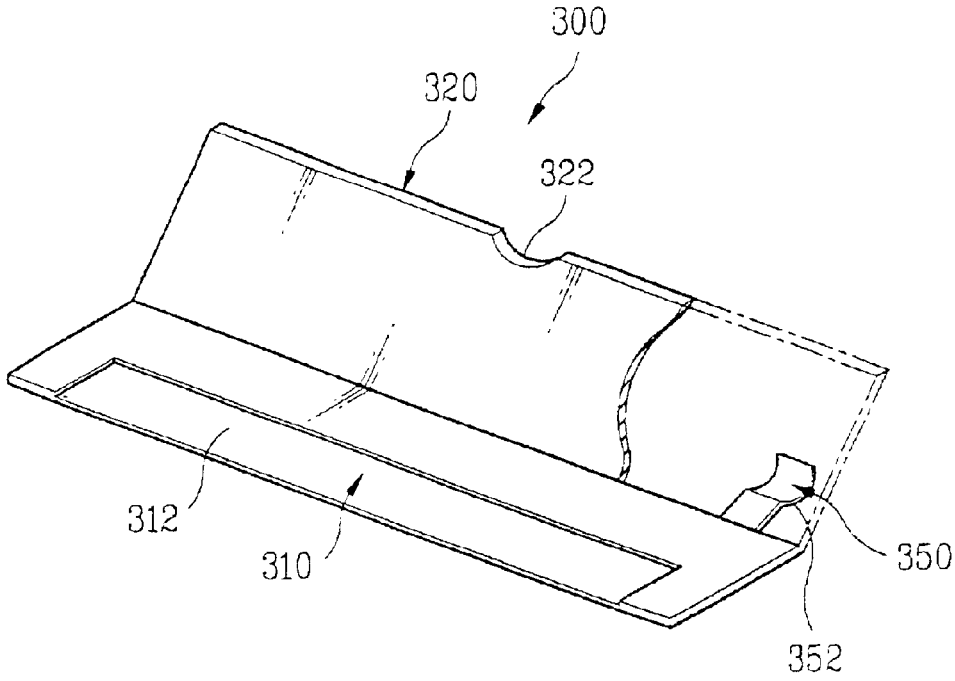
FIG. 11 illustrates a perspective view showing the fastening means in FIG. 10.
Figure 12:
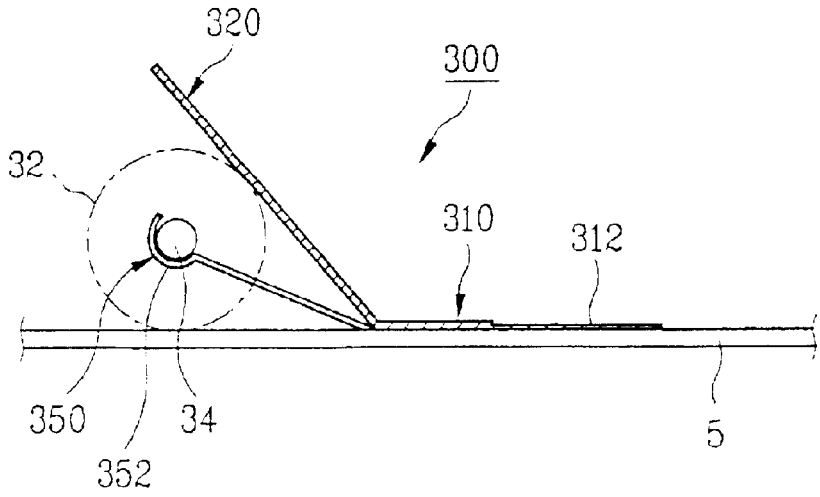
FIG. 12 illustrates a section showing the fastening means in FIG. 10 having the anti-howling means assembled thereto; and, FIG. 13 illustrates a plan view of FIG. 12.
Figure 13:
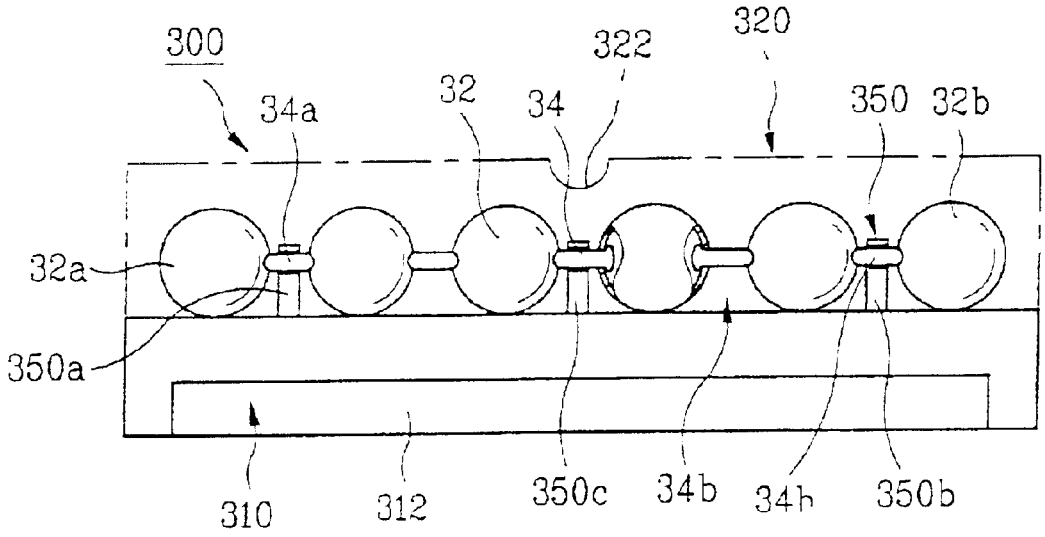

Referring to FIG. 8, it is preferable that there is a connecting part 210 for connecting the one pair of holding parts 220. However, the fixing means may only include the one pair of holding parts 220 and the fitting parts 230, without the connecting part 210.

In the meantime, it is preferable that the fixing means 200 and the anti-howling means 30 have structures that permit an easy assembly. Accordingly, it is preferable that there are assembly holes 212 and slots 214 and 224 in one side of the connecting part 210 and the holding parts 220. That is, there is the assembly hole 212 of a size substantially the same with the contact member 32 of the anti-howling means 30 in each side of the connecting part 210, and the slot 214 of a size substantially the same with a diameter of the connecting member 34 of the anti-howling means 30 at a side of the assembly hole 212. There is another slot 224 continuous to the slot 214 in the connecting part 210. In assembly of the anti-howling means 30 to the fixing means 200, the foregoing system permits completion of assembly merely by placing the anti-howling means 30 below the fixing means 200, drawing the contact members 32*a* and 32*b* at opposite ends thereof through the assembly holes 212, and moving along the slots 214 and 224. It is preferable that the holding part 220 has an indent 226 in a form fit to a profile of the contact member 32 of the anti-howling means 30, for preventing the anti-howling means 30 from being fallen off the fixing means 200 by an external impact in other fabrication step or during the product is in use after the anti-howling means 30 is assembled with the fixing means 200. Moreover, the indent 226 facilitates restoration of the contact member 32 to an original position even if the contact member 32 is moved for some extent.

In order to have a better contact between the contact member 32 of the anti-howling means 30 and the shadow mask 5, it is preferable that the anti-howling means 30 are fitted to the fixing means 200 under a tension. Therefore, a length between the holding parts 220 is made shorter than an effective length L of the anti-howling means 30. i.e., an entire length of the anti-howling means minus lengths of the contact members 32*a* and 32*b* at opposite ends thereof. This system enhances vibration suppression performance because the holding parts 220 exert tension to the contact means 32*a* and 32*b* at opposite ends thereof once fitting of the anti-howling means 30 to the connecting part 210 is completed. Of course, when the connecting part 210 is formed between the holding parts 220, the length of the connecting part 210 is formed shorter than the effective length 'L' of the anti-howling means 30.

It is preferable that each of the fitting parts 230 has a contact hole 232 formed therein so that the contact members 32*a* and 32*b* at opposite ends come into contact with the shadow mask 5, to provide a vibration suppression effect, for increasing a contact surface of the shadow mask 5 with the contact members 32, thereby enhancing the vibration suppression performance.

In the meantime, the fitting part 230 is joined to the shadow mask 5 by welding, or the like. Therefore, for improving contact between the fitting part 230 and the shadow mask 5, to improve joining and welding at the end, it is preferable that the fitting part 230 has a bead, i.e., a recess 234.

It is preferable that the anti-howling device is fitted to the effective area 5*a* in view of vibration suppression. However, the anti-howling device fitted to the effective area 5*a* may cause interference with the electron beams from the electron gun, it is preferable that the anti-howling device 5 is fitted to the non-effective area 5*b* of the shadow mask 5. In this instance, in order to permit the electron beams to reach to the effective area 5*a* at the maximum while avoiding interference for the electron beams directed to reference points at 12, or 6 o'clock, it is preferable that the connecting part 210 has a cutout 216 at a center of an edge.

In order to make an effective application of power to, or fix a position of the anti-howling means 30, a material or rigidity of the fixing means 200 may also be changed. That is, a different material may be bonded to a part of the fixing means 200, for an example, to a part which contacts with the contact member 32 of the anti-howling means 30, the fixing means 200 may be heat treated, a thickness, or a section of the fixing means 200 may be changed, or an inside of the fixing means 200 may be formed by molding.

Another embodiment of the fixing means will be explained, with reference to FIGS. 10–13.

The fixing means 300 includes a holding part 350 for holding the anti-howling means 30 to a required position of the shadow mask, a guiding part 320 for bringing the anti-howling means 30 into contact with the shadow mask 5, and a fitting part 310 having one side of the holding part 350 and one side of the guiding part 320 connected thereto and joined to the shadow mask 5.

The holding part 350 will be explained in detail.

The holding part 350 is fitted to a part between adjacent contact members 32, i.e., to the connecting member 34. Therefore, preferable, the holding part 350 is formed of plate, and more preferably, narrow. Furthermore, the holding part 350 preferably has a semicircular setting part 352 at a fore end thereof, for setting the connecting member 34 thereon. The setting part 352 is not limited to be circular, but may be a hook form, a ring form, and polygonal.

There are one pair 350*a* and 350*b* of the holding parts 350, preferably fitted to outermost pair of the connecting members 34*a* and 34*b*. This system facilitates that the setting part of the holding part 350 holds the connecting part 34, to fix the anti-howling means 30 at a required position because falling off of the contact member 32 is prevented by the holding part 350*a* and 350*b*. For more positive holding of the anti-howling means 30, a holding part 350*c* may be provided, additionally.

In order to make a better contact between the contact member 32 of the anti-howling means 30 and the shadow mask 5, it is preferable that the anti-howling means 30 is fitted to the fixing means 300 under tension.

Next, the guiding part 320 will be explained in detail.

Since the attenuation is enhanced the more as contact between the anti-howling means 30 and the shadow mask 5 is the better, the guiding part 320 is formed for improving the contact of the anti-howling means 300. The guiding part 320 is tilted toward the anti-howling means 30, for pressing the contact members 32 of the anti-howling means 30 down.

The fitting part 310 preferably has a bead, i.e., a recess 312 for improving contact between the fitting part 310 and the shadow mask 5, to improve joining and welding at the end.

It is preferable that the anti-howling device 20 is fitted to the effective area 5*a* in view of vibration suppression. However, the fitting of the anti-howling device 20 in the effective area 5*a* may cause problems of interference with the electron beams from the electron gun, the anti-howling device is fitted to the non-effective area 5*b* of the shadow mask 5. In this instance, in order to permit the electron beams to reach to the effective area 5*a* at the maximum while avoiding interference for the electron beams directed to reference points at 12, or 6 o'clock, it is preferable that the guiding part 320 has a cutout 322 at a center of an edge.

Though the anti-howling means 30 of the present invention is required to be fitted to the effective area or to the non-effective area, the fixing means 300 for fixing the anti-howling means 30 may be fitted to the mask holding frame 3 which fixes the panel 1 to the shadow mask.

In the foregoing embodiment, unification of the holding part 350, the guiding part 320, and the fitting part are illustrated and explained. Since this system facilitates fabrication of the fixing means 300 at a time by forming a sheet of plate, fabrication of the fixing means 300 is made easy.

However, the present invention is not limited thereto, but the fixing means 300 may be fabricated by fabricating the holding part 350, the guiding part 320, and the fitting part as separate components, and joining them together.

In order to make an effective application of power to, or fix a position of the anti-howling means 30, a material or rigidity of the fixing means 300 may also be changed. That is, a different material may bonded to a part of the fixing means 300, for an example, to a part which contacts with the contact member 32 of the anti-howling means 30, the fixing means 300 may be heat treated, a thickness, or a section of the fixing means 300 may be changed, or an inside of the fixing means 300 may be formed by molding.

As has been explained, the anti-howling device in a cathode ray tube of the present invention has the following advantages.

Figure 6:
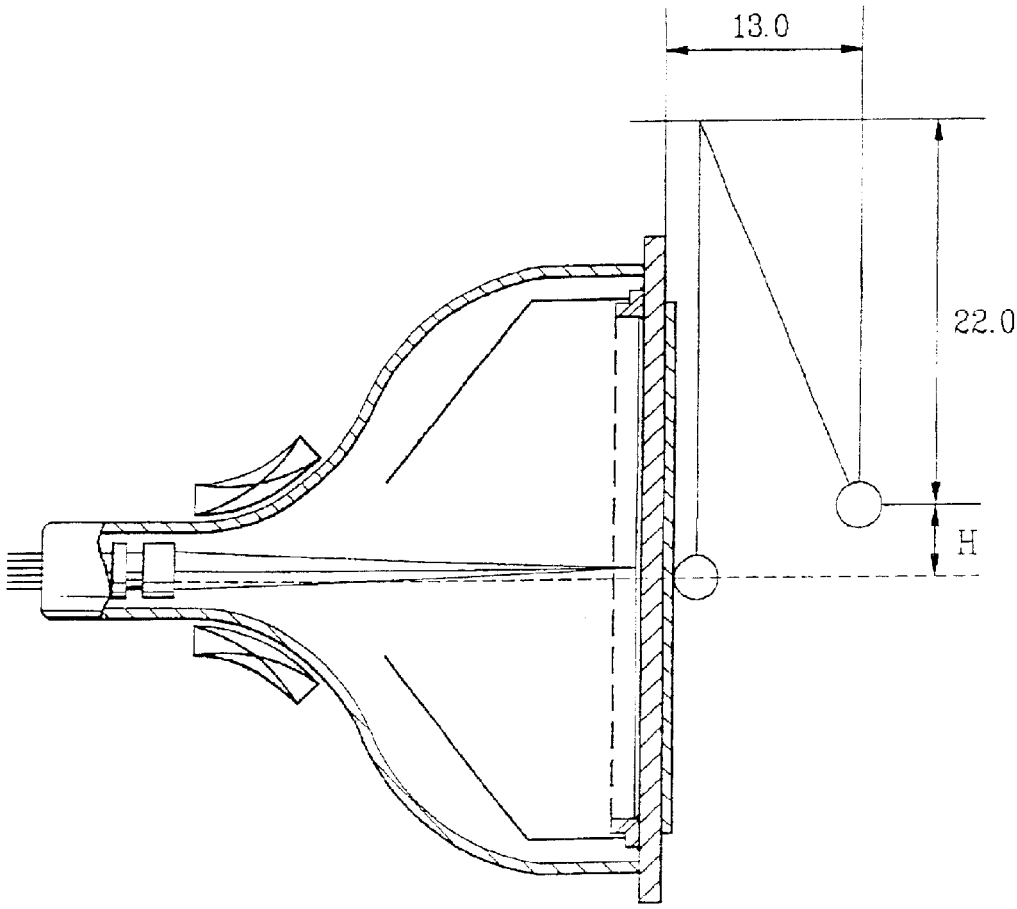
FIG. 6 illustrates a device for measuring howling and conditions for measuring the howling.

First, a vibration applied to the shadow mask can be attenuated, effectively. FIG. 6 illustrates a howling measuring device for verifying the vibration attenuation. An impact is given to the cathode ray tube with a 500 g steel ball at a height H 50 mm, and duration of vibration caused by the impact is measured. The durations for different anti-howling devices, i.e., for the related art wire type anti-howling means, the ball type anti-howling means, and the chain type anti-howling means, are measured under the same vibration condition. As a result of the measurement, the duration of the related art wire type anti-howling means is 40 seconds, the duration of the chain type anti-howling means is 10 seconds, and the duration of the ball type anti-howling means is 40 seconds. That is, it can be known that the anti-howling device of the present invention has a vibration suppression effect better than the related art wire type anti-howling means. Under a vibration condition different from above, the duration is measured to obtain a result, in which the related art wire type anti-howling means shows the duration of 20–40 seconds, while the anti-howling device of the present invention shows the duration of approx. 6–10 seconds. That is, the anti-howling device of the present invention has a very high reliability because the anti-howling device of the present invention is not much influenced from the vibration condition.

Second, the comparatively simple shape and the allowance of naked eye assembly of the anti-howling device of the present invention permits simplification of the fabrication process, reduction of defects, and shortening of process delay, thereby reducing a production cost.

Third, different from the related art wire type anti-howling device, the possibility of fitting of the anti-howling device of the present invention to the non-effective area of the shadow mask can prevent the wire shown on the screen after the device is fitted.

It will be apparent to those skilled in the art that various modifications and variations can be made in the anti-howling device in a cathode ray tube of the present invention without departing from the spirit or scope of the invention. Thus, it is intended that the present invention cover the modifications and variations of this invention provided they come within the scope of the appended claims and their equivalents.

What is claimed is:

1. An anti-howling device in a cathode ray tube having a shadow mask and a mask holding frame, comprising:

anti-howling means having a plurality of contact members, wherein each contact member is in contact with the shadow mask for receiving and dispersing a vibration, and connecting members for connecting adjacent contact members; and fixing means configured to bring the contact members into contact with the shadow mask, such that the contact members receive the vibration of the shadow mask and disperse the vibration by impact and friction between the contact members and the shadow mask.

2. An anti-howling device as claimed in claim 1, wherein each contact member is spherical with a pass through hole for passing an end of a connecting member.

3. An anti-howling device as claimed in claim 1, wherein each contact member is cylindrical with a pass through bole for passing an end of a connecting member.

4. An anti-howling device as claimed in claim 1, wherein each contact member comprises:

a contact part having a pass through hole at one side; and a connecting part formed as a unit with the contact part.

5. An anti-howling device as claimed in claim 1, wherein each contact member has a ring form.

6. An anti-howling device as claimed in claim 5, wherein each connecting member has a ring form.

7. An anti-howling device as claimed in claim 1, wherein the anti-howling means is fitted to a non-effective area of the shadow mask.

8. An anti-howling device as claimed in claim 1, wherein the fixing means is fitted to opposite ends of the anti-howling means.

9. An anti-howling device as claimed in claim 1, wherein the fixing means is fitted to a non-effective area of the shadow mask.

10. An anti-howling device as claimed in claim 1, wherein the fixing means is fitted to a mask holding frame.

11. An anti-howling device as claimed in claim 1, wherein the fixing means includes;

holding parts for holding opposite ends of the anti-howling means, and fitting parts each extended from the holding part for fitting to the shadow mask, wherein the contact members are brought into contact with the shadow mask by using an elastic tension of the holding parts.

12. An anti-howling device as claimed in claim 11, wherein a length between the holding parts is formed shorter than an effective length of the anti-howling means for applying tension to the anti-howling means when the anti-howling means is held by the holding parts.

13. An anti-howling device as claimed in claim 11, wherein each holding part comprises an indent fit to a profile of one of the contact members in the anti-howling means.

14. An anti-howling device as claimed in claim 11, wherein the fitting part comprises a contact hole in conformity with a lower part of one of the contact members in the anti-howling means for bringing one of the contact members into contact with the shadow mask through the contact hole.

15. An anti-howling device as claimed in claim 11, wherein the fitting part includes a recess projected in a direction of the shadow mask.

16. An anti-howling device as claimed in claim 11, wherein the fixing means further includes a connecting part for connecting the holding parts.

17. An anti-howling device as claimed in claim 16, wherein the connecting part has a length shorter than an effective length of the anti-howling means for applying tension to the anti-howling means when the anti-howling means is held by the holding parts.

18. An anti-howling device as claimed in claim 17, wherein the connecting part comprises assembly holes each having a size almost the same with one of the contact members and slots each connected to one of the assembly holes having a size almost the same with a diameter of one of the connecting members in the anti-howling means, and each holding part comprises a slot connected to one of the slots in the connecting part.

19. An anti-howling device as claimed in claim 17, wherein the connecting part comprises a cutout at an approximate center of an edge of the connecting part.

20. An anti-howling device as claimed in claim 1, wherein the fixing means comprises:

a guiding part for bringing the contact members in the anti-howling means into contact with the shadow mask, a holding part for holding the connecting members in the anti-howling means, and a fitting part fitted to the shadow mask and connected to the holding part and the guiding part.

21. An anti-howling device as claimed in claim 20, wherein the fitting part is fixed to a mask holding frame.

22. An anti-howling device as claimed in claim 20, wherein the fitting part is fixed to the non-effective area of the shadow mask.

23. An anti-howling device as claimed in claim 20, wherein the fitting part includes a recess projected in a direction of the shadow mask.

24. The anti-howling device as claimed in claim 1, wherein the connecting members have a form that is substantially identical to the contact members.

25. The anti-howling device as claimed in claim 1, wherein each contact member is hexahedral.

26. The anti-howling device as claimed in claim 1, wherein the contact members include a hollow aperture.

27. The anti-howling device as claimed in claim 26, wherein at least one of the contact members has a supplementary contact member located in the hollow aperture.

28. The anti-howling device as claimed in claim 1, wherein a shape of each contact member is one of spherical, cylindrical, hexahedral, and a ring.

29. A vibration damper for use in a cathode ray tube having a shadow mask, comprising:

a plurality of contact members in contact with a shadow mask and adapted to receive and disperse a vibration;

a plurality of connecting members, each connecting member disposed between adjacent contact members and adapted to connect the adjacent contact members; and a holding member connected to at least one of the plurality of contact members and adapted to hold the plurality of contact members in contact with the shadow mask.

30. A vibration damper for use in a cathode ray tube having a shadow mask, comprising:

a plurality of contact members in contact with a shadow mask and adapted to receive and disperse a vibration, wherein a shape of each of the plurality of contact members is one of spherical, cylindrical, hexahedral, and ring; and a plurality of connecting members, each connecting member disposed between adjacent contact members and adapted to connect the adjacent contact members.

31. A vibration damper for use in a cathode ray tube having a shadow mask, comprising:

a plurality of contact members in contact with a shadow mask and adapted to receive and disperse a vibration, wherein at least one of the plurality of contact members is hollow; and a plurality of connecting members, each connecting member disposed between adjacent contact members and adapted to connect the adjacent contact members.

32. The vibration damper of claim 31, wherein at least one of the plurality of contact members has a supplementary contact member located within a hollow portion of the at least one contact member.

* * * * *